US006070701A

United States Patent [19]

Hu

[11] Patent Number: 6,070,701

[45] Date of Patent: Jun. 6, 2000

[54] WHEEL DEVICE FOR A BABY WALKER

[76] Inventor: Stephen Hu, No 2, Ta-Tung Road, Hsin-Chu Industrial Park, Taiwan

[21] Appl. No.: 09/122,416

[22] Filed: Jul. 24, 1998

[51] Int. Cl.[7] ..... B60B 33/00

[52] U.S. Cl. ..... 188/1.12; 188/82.84; 16/24; 280/87.051

[58] Field of Search ..... 188/1.12, 19, 20, 188/181 A, 82.84; 16/24, 26, 18 R, 35 D; 280/87.051

[56] References Cited

U.S. PATENT DOCUMENTS

| | | | |
|---|---|---|---|
| 1,864,142 | 6/1932 | Meyer | 192/219.3 |
| 3,075,232 | 1/1963 | Rice et al. | 16/18 R |
| 3,623,575 | 11/1971 | Schiltigheim et al. | 188/31 |
| 5,785,154 | 7/1998 | Chen | 188/1.12 |

*Primary Examiner*—Douglas C. Butler
*Assistant Examiner*—Lan Nguyen
*Attorney, Agent, or Firm*—Pro-Techtor International Services

[57] ABSTRACT

A wheel device for a baby walker provided on the bottom surface of a chasis of the baby walker, it is comprised of a first semi-sphere provided with a fixing portion fixed on the bottom surface of the chasis; a second semi-sphere exactly closely covering the first semi-sphere and rotating on the ground relative to the first semi-sphere, and forming with the first semi-sphere a spherical receiving space; a stop piece provided in the receiving space, a slide way with a variable width is formed between the stop piece and the inner wall of the second semi-sphere; a roller provided on the slide way and contacting the inner wall of the second semi-sphere; thereby when the wheel is rolled and accelerated to a predetermined speed, by the friction force between the roller and the stop piece and the second semi-sphere, the roller is moved toward a narrower area of the slide way, and is limited to the area between the second semi-sphere and the stop piece, so that said wheel gets the function of speed reducing as well as braking.

10 Claims, 6 Drawing Sheets

WHEEL DEVICE FOR A BABY WALKER

BACKGROUND OF THE INVENTION

1. Field of the Invention

The present invention relates to a wheel device for a baby walker, and especially to such a device on the baby walker, by the device, wheel speed of the baby walker can be automatically reduced and the wheels can be braked when the baby walker is used, thereby using of the baby walker can be safer.

2. Description of the Prior Art

A baby walker is provided for enstrengthening force and agility of the feet of a baby in learning walking in a safe way. However, the wheels of a common baby walker do not have an effect of braking, when a baby moves fast in such a baby walker, the walker is subjected to turning upside down or large vibration, and safety of the baby walker is worriable. And more, if the baby runs too fast, while speed of the wheels of the baby walker can not be reduced, the baby walker is subjected to falling down stairs when it passes a stair way, braking sheets provided on the bottom of the baby walker can not give a braking function, thereby safety of the baby walker is really worriable.

SUMMARY OF THE INVENTION

In view of the above statement, the inventor of the present invention provides after hard study a wheel device for a baby walker, the device has the function of speed reducing as well as braking, so that the baby walker can be safer in use.

The primary object of the present invention is to provide the wheel device for a baby walker which has the function of speed reducing as well as braking, so that the baby walker is safer in use.

The present invention will be apparent after reading the detailed description of the preferred embodiments of the present invention in reference to the accompanying drawings, wherein:

DETAILED DESCRIPTION OF THE PREFERRED EMBODIMENT

Figure 1:
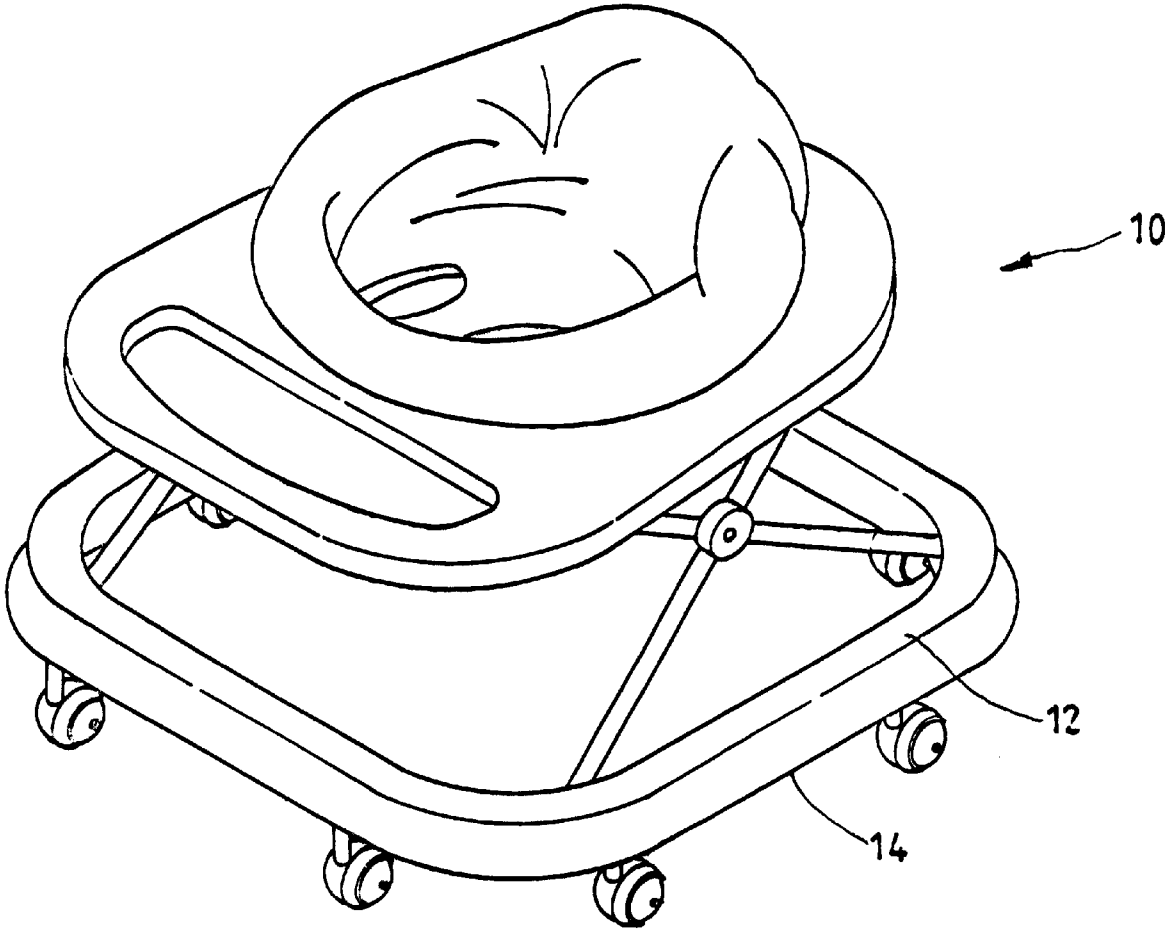
FIG. 1 is a perspective view of the baby walker of the present invention.
Figure 2:
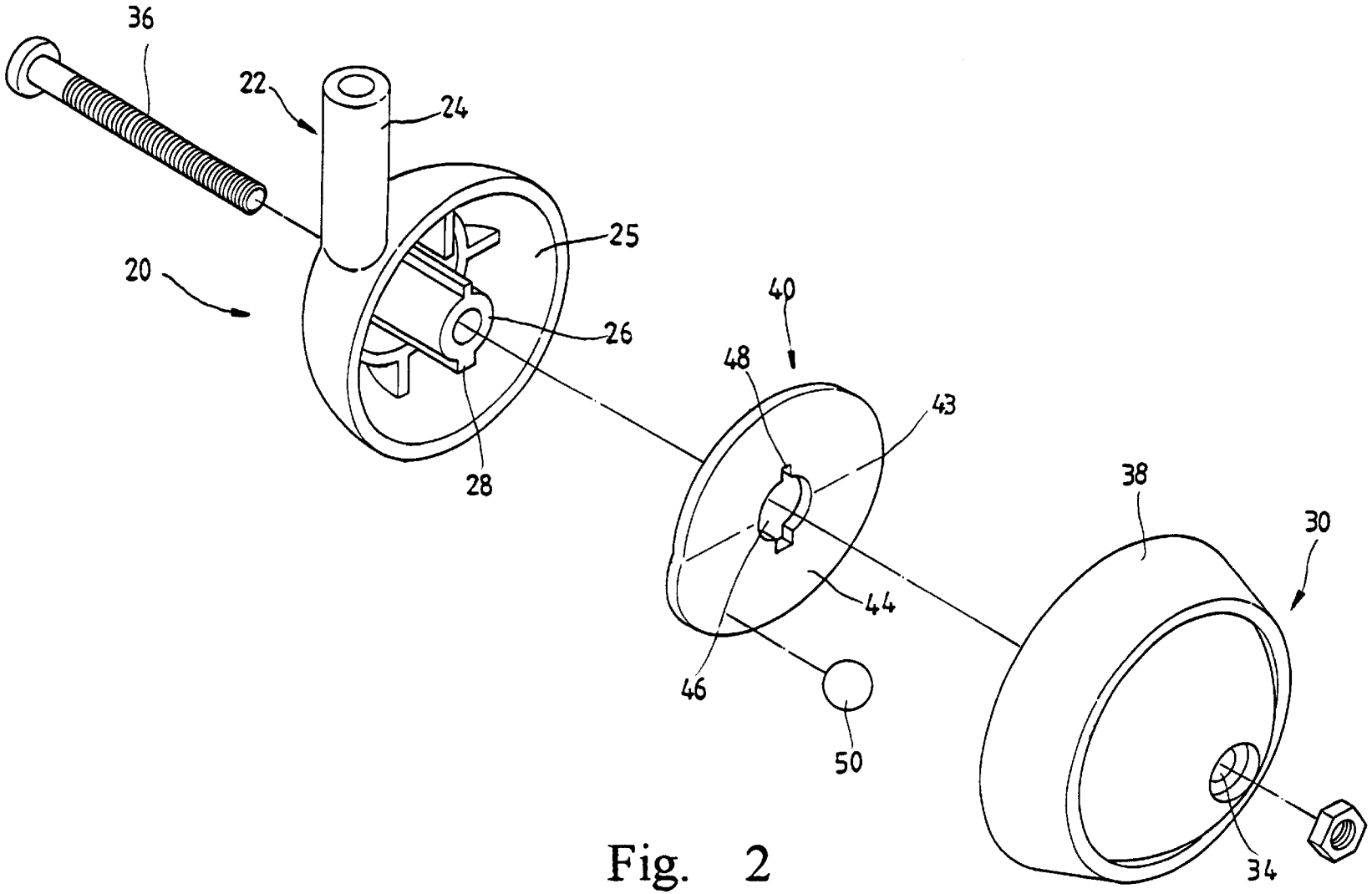
FIG. 2 is an analytic perspective view of a wheel device of the baby walker of the present invention.

Referring firstly to FIGS. 1 and 2, the wheel device of the present invention is provided on the bottom surface 14 of the chasis 12 of a baby walker 10, by the device, the baby walker 10 can be appropriately moved to allow a baby to learn walking and practise its feet to increase strength. The wheel device is comprised of a first semi-sphere 20, a second semi-sphere 30, a stop piece 40 and a roller 50.

The first semi-sphere 20 is provided with a fixing portion 22 fixed on the bottom surface 14 of the chasis 12 of the baby walker 10, the fixing portion 22 is a protruding rod 24 extending upwardly, the wheel device can be fixed on the baby walker 10 by means of the protruding rod 24. The first semi-sphere 20 is provided therein with a semi-spherical receiving chamber 25 which is provided therein with a transverse pipe 26, the first semi-sphere 20 is provided further therein with an engaging portion for positioning the stop piece 40 but slightly shakable in the first semi-sphere 20, the engaging portion is provided with two engaging strips 28 on two mutually opposite sides of the transverse pipe 26.

The second semi-sphere 30 can exactly closely cover the first semi-sphere 20 and rotates on the ground relative to the first semi-sphere 20, and is provided therein with a receiving chamber too (not shown) which forms with the receiving chamber 25 in the first semi-sphere 20 a spherical receiving space. The second semi-sphere 30 is provided at the center thereof with a screw hole 34, a locking screw 36 is extended through the transverse pipe 26 of first semi-sphere 20 and the screw hole 34, so that the first semi-sphere 20 and the second semi-sphere 30 can be rotated relative to each other. The external surface of the second semi-sphere 30 is a bevelled surface 38 which contacts the ground when the wheel is rolled.

Figure 3:
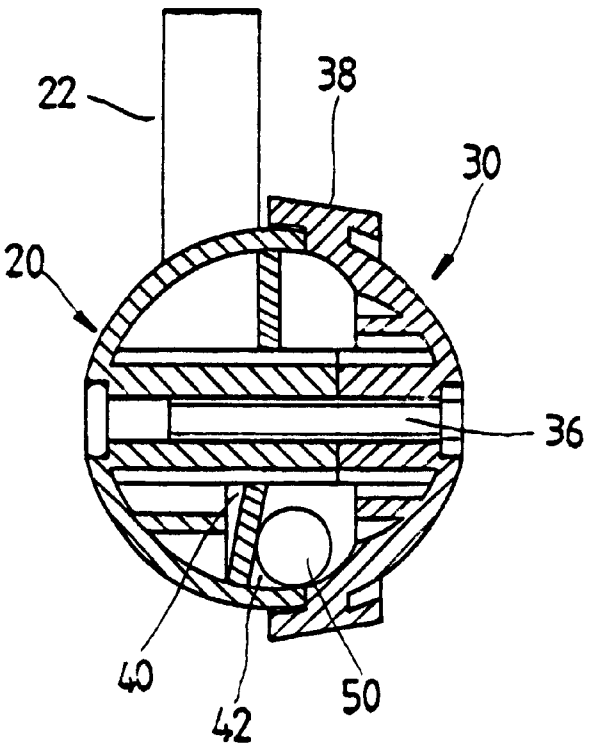
FIG. 3 is a sectional view showing the wheel device for the baby walker of the present invention after assembling.

The stop piece 40 is provided in the receiving space formed by the first semi-sphere 20 and the second semi-sphere 30, and more precisely is provided upright in the first semi-sphere 20, and is suitably bended at a central linear bending area 43 thereof to form a bended portion 44, so that a slide way 42 having a variable width which reduces from its lower portion to its upper ends is formed between the bended portion 44 of the stop piece 40 and the inner wall of the second semi-sphere 30 (as shown in FIG. 3). The stop piece 40 is provided at the center thereof with a hole 46 corresponding in shape to that of the end of the transverse pipe 26 of the first semi-sphere 20, the hole 46 can be slipped over the transverse pipe 26, and is provided on the periphery thereof with notches 48 coincedent in shape with the two engaging strips 28 of the transverse pipe 26, so that the stop piece 40 can be positioned on the transverse pipe 26 but is slightly shakable.

The roller 50 is provided in the archform receiving space formed by the first semi-sphere 20 and the second semi-sphere 30, and is located on the slide way 42 formed between the stop piece 40 and the second semi-sphere 30 and rolls on the slide way 42 but is limited by the narrower areas of the slide way 42. By the slight shakable feature of the stop piece 40, when the roller 50 is limited by the narrower areas of the slide way 42, an effect of speed reducing can be obtained.

Referring to FIG. 3, when the second semi-sphere 30 is rolled with a suitable low speed on the ground, the roller 50 is constantly located at a narrower area of the slide way 42, so that the second semi-sphere 30 can always be rotated relative to the first semi-sphere 20.

Figure 4:
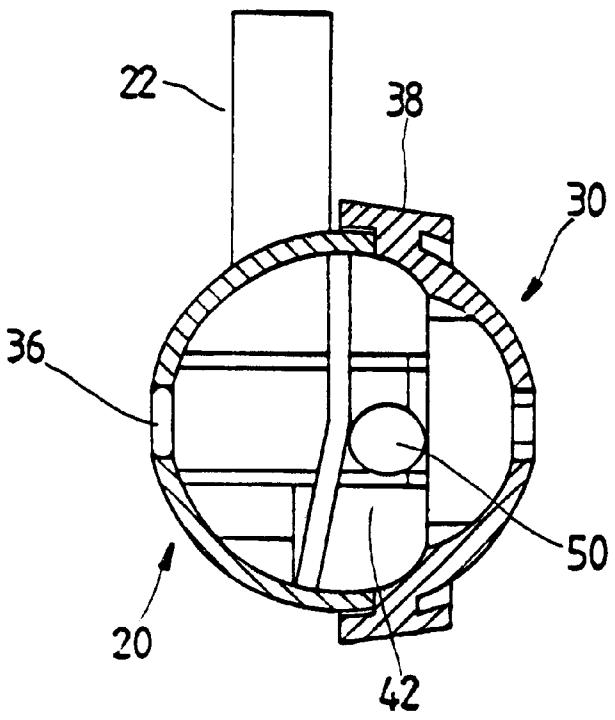
FIG. 4 is a schematic view of the present invention showing the motion in the wheel device shown in FIG. 3.

Referring to FIG. 4, when the second semi-sphere 30 is rolled on the ground and accelerated to a predetermined speed, by the friction force between the roller 50 and the stop piece 40 and the second semi-sphere 30, the roller 50 can be moved toward a narrower area of the slide way 42, and is limited to the area between the second semi-sphere 30 and the stop piece 40, so that the second semi-sphere 30 gets the function of speed reducing as well as braking, thereby the baby walker can have the effect of speed reducing and braking.

If speed of the second semi-sphere 30 is overly fast to thereby render the roller 50 to be blocked between the second semi-sphere 30 and the stop piece 40, it needs only to roll the second semi-sphere 30 toward any other direction, the roller 50 can then drop to a wider area of the slide way 42, in this way, the second semi-sphere 30 can restore its rolling motion, and the baby walker can restore its state for use.

Figure 5:
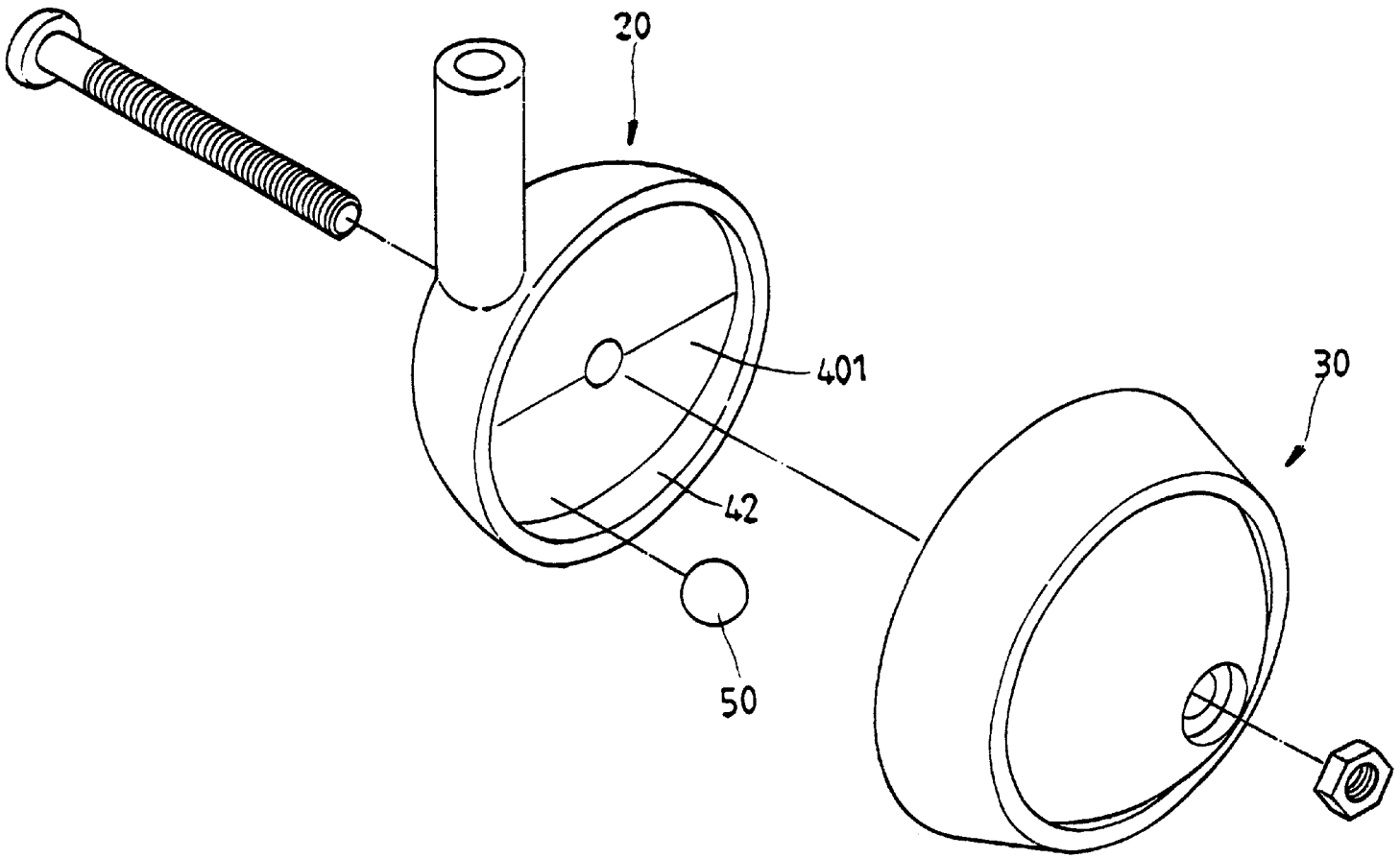
FIG. 5 is a perspective view showing the second embodiment of the present invention.
Figure 6:
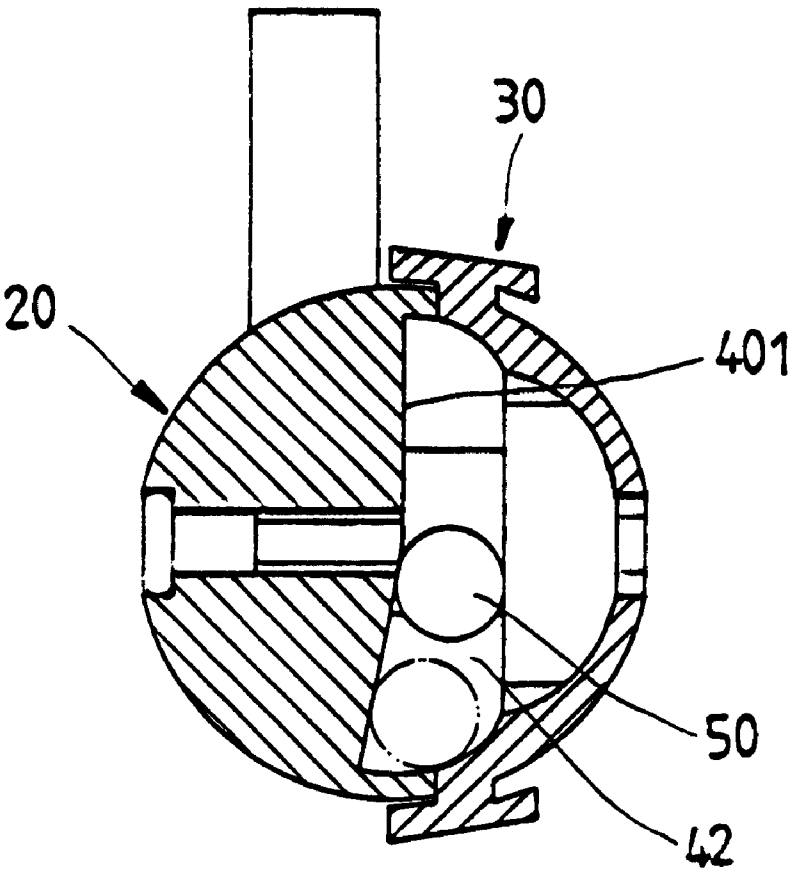
FIG. 6 is a schematic view of the present invention showing the motion in the wheel device shown in FIG. 5.

Referring to FIG. 5 which shows the second embodiment of the present invention, wherein, a stop piece 401 is integrately formed in the receiving chamber 25 of the first semi-sphere 20, the stop piece 401 forms a slide way 42 having a variable width together with the second semi-sphere 30 too. Referring to FIG. 6, when speed of the second semi-sphere 30 is overly fast, the roller 50 can be moved toward a narrower area of the slide way 42 by the friction force between the roller 50 and the second semi-sphere 30 and the stop piece 401 to thereby render the roller 50 to be blocked between the second semi-sphere 30 and the stop piece 401 to limit rotation of the second semi-sphere 30 or reduce its speed.

Figure 7:
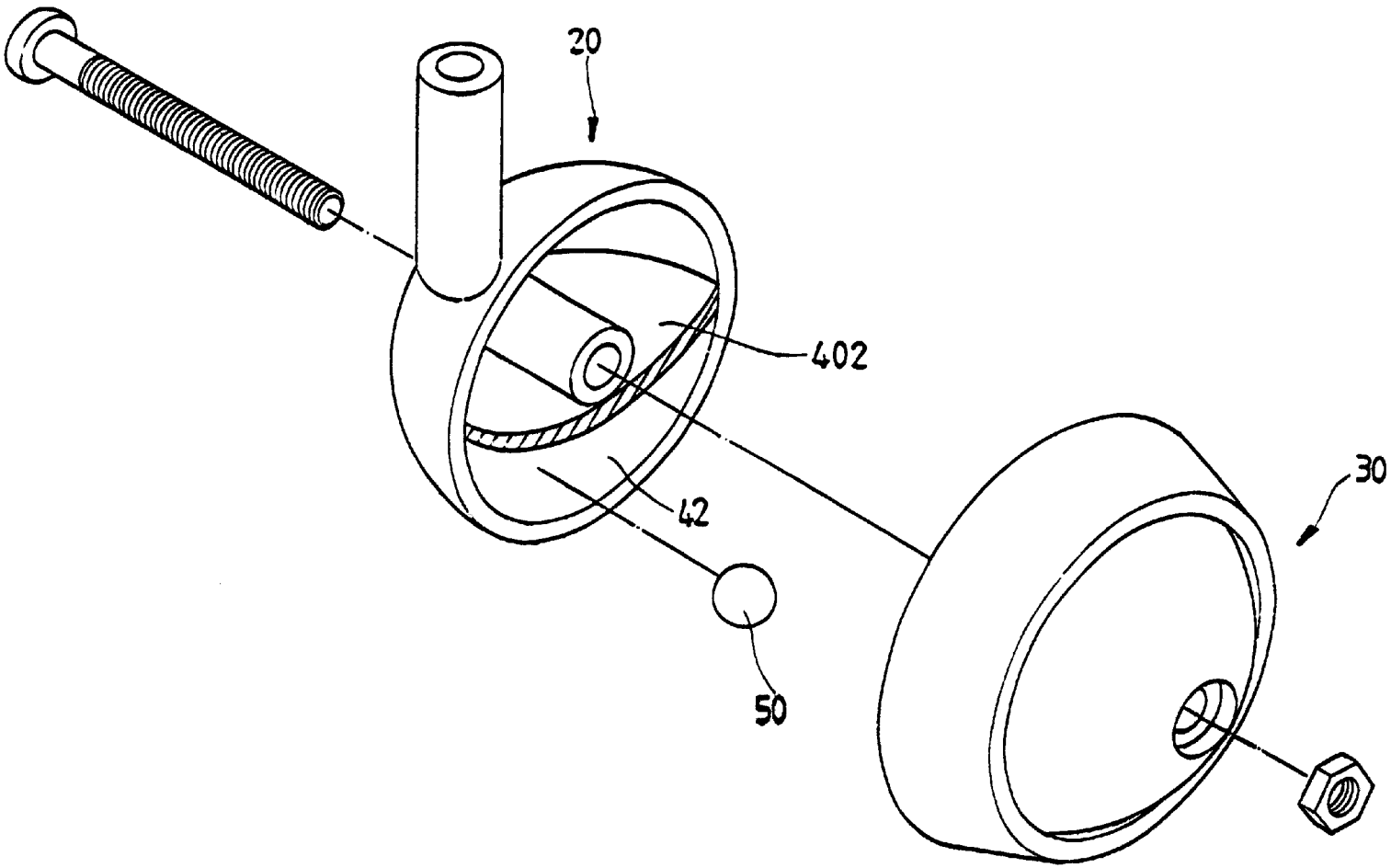
FIG. 7 is a perspective view showing the third embodiment of the present invention.

Referring to FIG. 7 which shows the third embodiment of the present invention, wherein, a stop piece 402 is archform and horizontally provided in the first semi-sphere 20 and forms a slide way 42 having a variable width together with the first semi-sphere 20, while the roller 50 is provided on the slide way 42 and can be moved toward a narrower area of the slide way 42 by the friction force between the roller 50 and the second semi-sphere 30 and the stop piece 402 to thereby render the roller 50 to be blocked between the second semi-sphere 30 and the stop piece 402 to reduce speed of rotation of the wheel or make a braking.

By the above stated structural combinations, the wheel device for a baby walker of the present invention is provided on the baby walker, when a baby uses it for learning walking, and if speed of the baby walker is overly fast, by speed reducing and braking function of the wheel device, using of the baby walker can be safer. The present invention can surely achieve its object and effect, therefore is industrially valuable.

Obviously, many modifications and variations of the present invention are possible in the light of the above teachings. It is therefore to be understood that within the scope of the appended claims and without departing from the spirit thereof, the invention may be practiced otherwise than as specifically described.

Having thus described my invention, what I claim as new and desire to be secured by Letters Patent of the United States is:

1. A wheel device for a baby walker, being provided on a bottom surface of a chasis of said baby walker, and being comprised of:

a first semi-sphere provided with a fixing portion adapted to be fixed on said bottom surface of said chasis of said baby walker;

a second semi-sphere exactly closely covering said first semi-sphere and rotating on the ground relative to said first semi-sphere, and forming with a receiving chamber in said first semi-sphere a spherical receiving space;

a stop piece provided in said receiving space formed by said first semi-sphere and said second semi-sphere, a slide way is formed between said stop piece and the inner wall of said second semi-sphere;

a roller provided on said slide way and contacting said inner wall of said second semi-sphere, when said wheel is rolled on the ground and accelerated to a predetermined speed, by the friction force between said roller and said stop piece and said second semi-sphere, said roller is moved toward a narrower area of said slide way, and is limited to the area between said second semi-sphere and said stop piece, so that said wheel gets the function of speed reducing as well as braking.

2. A wheel device for a baby walker as in claim 1, wherein, said fixing portion of said first semi-sphere is a protruding rod extending upwardly for being fixed on said chasis of said baby walker.

3. A wheel device for a baby walker as in claim 1, wherein, said first semi-sphere and said second semi-sphere are provided respectively with a central transverse pipe and a screw hole, a locking screw member is extended in said transverse pipe and said screw hole, so that said second semi-sphere can be assembled on and rotated relatively to said first semi-sphere.

4. A wheel device for a baby walker as in claim 1, wherein, said first semi-sphere is provided therein with an engaging portion for fixedly engaging said stop piece in said first semi-sphere.

5. A wheel device for a baby walker as in claim 4, wherein, said stop piece is provided at the center thereof with a hole, said engaging portion of said first semi-sphere is provided peripherally of a transverse pipe with engaging strips, said stop piece is provided on the periphery thereof with notches, so that said stop piece can be positioned on said first semi-sphere but is slightly shakable therein.

6. A wheel device for a baby walker as in claim 1, wherein, said second semi-sphere is provided on the external surface thereof with a bevelled surface which contacts the ground when said wheel is rotated.

7. A wheel device for a baby walker as in claim 1, wherein, said stop piece is provided upright in said first semi-sphere, and is provided with a bended portion in order that said slide way with a variable width is formed between said bended portion and said inner wall of said second semi-sphere.

8. A wheel device for a baby walker as in claim 1, wherein, said stop piece is integrately formed in said receiving chamber of said first semi-sphere.

9. A wheel device for a baby walker as in claim 1, wherein, said stop piece is bended at the center thereof to form said bended portion, so that said slide way can have a variable width which reduces from its lower portion to its upper ends.

10. A wheel device for a baby walker as in claim 1, wherein, said stop piece is archform and horizontally provided in said first semi-sphere to form a slide way having a variable width together with said first semi-sphere.

* * * * *